US011421393B2

(12) United States Patent
Nowak et al.

(10) Patent No.: US 11,421,393 B2
(45) Date of Patent: Aug. 23, 2022

(54) VAPOR MITIGATION APPARATUS AND METHOD

(71) Applicants: Dave Nowak, Lethbridge (CA); David Caruso, Lethbridge (CA); Anthony Wayne Caruso, Lethbridge (CA)

(72) Inventors: Dave Nowak, Lethbridge (CA); David Caruso, Lethbridge (CA); Anthony Wayne Caruso, Lethbridge (CA)

( * ) Notice: Subject to any disclaimer, the term of this patent is extended or adjusted under 35 U.S.C. 154(b) by 0 days.

(21) Appl. No.: 16/988,557

(22) Filed: Aug. 7, 2020

(65) Prior Publication Data

US 2020/0370267 A1 Nov. 26, 2020

Related U.S. Application Data

(63) Continuation-in-part of application No. 16/288,034, filed on Feb. 27, 2019, now abandoned.

(51) Int. Cl.

| | |
|---|---|
| ***E02D 31/00*** | (2006.01) |
| ***E04B 1/66*** | (2006.01) |
| ***E02D 31/02*** | (2006.01) |

(52) U.S. Cl.
CPC ..... *E02D 31/008* (2013.01); *E02D 31/02* (2013.01); *E04B 1/665* (2013.01)

(58) Field of Classification Search
CPC ..... E04B 1/7069; E04B 1/665; F24F 7/06; F24F 2110/66; F24F 2007/001;
(Continued)

(56) References Cited

U.S. PATENT DOCUMENTS 2,271,143 A * 1/1942 Martinus ..... E04D 11/02 52/58
3,725,185 A * 4/1973 Curtis ..... E04B 1/66 442/37

(Continued)

FOREIGN PATENT DOCUMENTS

WO WO-2004106642 A1 * 12/2004 ..... E02D 31/02

*Primary Examiner* — Brent W Herring
(74) *Attorney, Agent, or Firm* — Stratford Group Ltd.

(57) ABSTRACT

A vapor mitigation apparatus and method for use with the construction of a building. The apparatus includes a vertical member configured to be affixed to a foundation wall proximate a footing that is supporting the foundation wall. The vertical member has a first end located proximate to a footing and a second end. A horizontal foot is located at the first end of the securing piece. The horizontal foot is configured to rest against the footing. The apparatus may include a mechanical clip located at the second end of the vertical member and is configured to secure a gas impermeable membrane. In the alternative, the vertical member and the gas impermeable membrane are of a unitary structure. The method includes securing the apparatus to the foundation wall, sealing the gas impermeable membrane to a membrane that is covering the footings or granular base of the building and then creating a concrete slab by pouring concrete over the footing and apparatus. The apparatus may also include a membrane material and a rigid ring located at the approximate center of the membrane material. An inner portion of the membrane material is located inside the perimeter of the ring. The rigid ring is configured to be located around one of the at least one penetration such that the inner portion of the membrane material is configured to stretch around the one penetration resulting in the sealing of the apparatus to the penetration.

7 Claims, 24 Drawing Sheets

(58) Field of Classification Search
CPC ..... F24F 2110/68; E02D 31/02; E02D 31/00; E02D 31/008; E04F 19/04
USPC ..... 52/261, 264, 265, 269, 272, 273, 274, 52/282.1, 282.4
See application file for complete search history.

(56) References Cited

U.S. PATENT DOCUMENTS

| | | | | | |
|---|---|---|---|---|---|
| 4,245,443 | A * | 1/1981 | Beechen | E04B 1/7023 | 52/302.3 |
| 4,706,427 | A * | 11/1987 | Zeilinger | A47K 3/001 | 52/287.1 |
| 4,923,331 | A * | 5/1990 | Kreikemeier | E02B 11/00 | 405/36 |
| 5,771,643 | A * | 6/1998 | Parker | E02D 27/32 | 52/302.1 |
| 7,735,271 | B1 * | 6/2010 | Shipston | E04B 1/0007 | 52/169.11 |
| 9,404,234 | B2 * | 8/2016 | Jain | E04B 2/22 | |
| 10,662,607 | B2 * | 5/2020 | Trebil | E04B 1/7023 | |
| 10,787,823 | B2 * | 9/2020 | Lavallie | E04F 15/06 | |
| 10,870,982 | B2 * | 12/2020 | Rudyan | B32B 11/048 | |
| 10,968,596 | B2 * | 4/2021 | Rudyan | E02D 31/025 | |
| 2004/0261337 | A1 * | 12/2004 | Hubert | E02D 31/02 | 52/272 |
| 2009/0117319 | A1 * | 5/2009 | Hubert | E02D 31/02 | 428/77 |
| 2014/0237922 | A1 * | 8/2014 | Jain | E04B 2/08 | 52/293.2 |
| 2020/0063393 | A1 * | 2/2020 | Trebil | E04B 1/7023 | |
| 2020/0141112 | A1 * | 5/2020 | Rudyan | E04B 1/946 | |
| 2020/0141133 | A1 * | 5/2020 | Lavallie | E04F 19/04 | |

* cited by examiner

FIG. 1 – PRIOR ART

VAPOR MITIGATION APPARATUS AND METHOD

REFERENCE TO PENDING APPLICATIONS

This application claims the benefit of pending U.S. patent application Ser. No. 16/288,034, filed Feb. 27, 2019 and entitled Vapor Mitigation Apparatus and Method.

TECHNICAL FIELD

The present invention is generally directed toward a vapor mitigation, and more specifically, toward the mitigation of radon vapor in the construction of buildings.

BACKGROUND

Radon is a colorless, odorless gas that can cause lung cancer. Radon gas can move through small spaces in the soil and rock upon which a house is built. It can seep into a home through dirt floors, cracks in concrete walls and floors, sumps, joints, basement drains, under the furnace base, and jack posts if the base is buried in the floor.

FIG. 1 illustrates a prior art system 10 to reduce the amount of radon gas from seeping into a house. As illustrated, the prior art system 10 utilizes a gas permeable layer 12 that is created below the building slab 14, which is usually made from concrete. The gas permeable layer 12 allows the radon gas to move laterally beneath the slab 14 to the location where a vent pipe can collect the gas and transport it away from the building. The gas permeable layer 12 is usually created with drainage rock, crushed gravel and/or other drainage material. Surrounding the gas permeable layer 12 are the building's footings 16 and foundation wall 18. The prior art system 10 places a layer of plastic sheeting 20 between the gas permeable layer 12 and the slab 14. The joint seams and all openings between the foundation wall 18 and slab 14 are sealed with an elastomeric sealant 22 such as polyurethane caulk.

The prior art, however, has disadvantages. The footings are purposely poured very rough and porous for proper adhesion of the foundation wall, which is poured on top of the footings. The footings can become soiled with dirt, sand, fine gravel, or other contaminants preventing a proper seal between the footing and membrane.

Further, it is difficult to determine if the plastic sheeting 20 remained in place over the gas permeable layer 12 after the concrete that forms slab 14 is poured thereon, or if the plastic sheeting 20 has moved. If the plastic sheeting 20 remained in place, an airtight seal may be created. However, if there is movement, an airtight seal may not have been created. Due to the sheeting 20 being located under the slab 14, there is no way to make this determination.

Additionally, during the installation of a Radon gas membrane overtop of a granular fill within the footing area of foundations, crawlspaces or monolithic slabs on grade, objects of penetrations are typically encountered which have to be properly sealed to prevent the seepage of Radon Gas into the building or structure. These penetrations typically are plumbing drain stacks, floor drains, water mains, electrical conduit, sewer back flow preventer boxes otherwise known as clean out boxes, sump pump barrels, post/columns, and other such penetrations.

The prior art practice to seal these penetrations includes cutting the Radon gas membrane as close to the penetration as possible and securing the cut membrane with sealant tape. The disadvantage of the prior art is that penetrating object is comprised of different elements such as: PVC, ABS, poly, composite plastics, steel, wood, etc. As such, the securing tape must be able to adhere and seal to a multitude of materials, which is not always possible. Further, the seal created by the sealing tape depends on the cleanliness of the penetrating object, as well as other objects on the construction site. As construction sites are usually not very clean, the use of sealing tape is challenging at best. Still, another disadvantage that can compromises the seal is due to movement of the Radon membrane or penetrating object during the time when the concrete slab floor is being poured.

Accordingly, there is a need for an apparatus and method to address the issues set out above.

SUMMARY

The present invention is generally directed toward vapor mitigation, and more specifically, toward the mitigation of vapor in the construction of buildings, including the fastening of tarps, membranes, poly layers, etc.

In one aspect, a vapor mitigation apparatus for use with the construction of a building is disclosed. The building has a gas permeable layer surround by a foundation wall and footing. A sheet of plastic sheeting is placed between the gas permeable layer and the buildings slab. The term plastic sheeting is used to mean any type of plastic sheet, membrane, film or other continuous polymeric material that is used to separate areas or volume to act as a barrier.

The apparatus includes a vertical securing piece configured to be affixed to the foundation wall by adhesion or other known securing fasteners. The securing piece has a first end located proximate to the footing and a second end. A horizontal foot is located at the first end of the securing piece and extends away from the securing piece. The horizontal foot is configured to rest on the footing that is supporting the foundation wall. A mechanical clip is located at the second end of the securing piece and is configured to secure the piece of plastic sheeting. This creates an airtight seal between the ground below the building and the building.

In some aspects, the mechanical clip includes a first jaw member and a second jaw member that is hinged to the first jaw member. In the locked, or closed, position, the first jaw member and second jaw member are configured to secure the piece of plastic sheeting therebetween.

In some aspects, the mechanical clip includes a base member extending substantially horizontally away from securing piece. The base member has a locking portion at its distal end. The mechanical clip further includes a retention member that configured to be depressed against the locking portion. In the locked, or closed, position the retention member and locking portion are configured to secure the piece of plastic sheeting therebetween.

In one aspect, a method for vapor mitigation in the construction of a building is disclosed. The method includes utilizing a vapor mitigation apparatus having a vertical securing piece having a first end located and a second end, a horizontal foot located at the first end of the securing piece and extending away from the securing piece, and a mechanical clip located at the second end and configured to secure a piece of plastic sheeting. The method includes affixing the vertical securing piece to the circumference of the foundation wall such that the horizontal foot rest on the footing, placing a piece of plastic sheeting over the gas permeable layer, securing the ends of piece of plastic sheeting to mechanical clip thereby creating a vapor barrier over the gas permeable layer, and creating a slab of concrete by pouring a sufficient amount of concrete over the vapor mitigation apparatus and plastic sheeting.

In another aspect, the vapor mitigation apparatus may include a vertical securing piece configured to be affixed to a foundation wall. The vertical securing piece having a first end located proximate to a footing and a second end. A horizontal foot may be located at the first end of the securing piece and extending away from the securing piece. A mechanical clip may be located at the second end. A securing bar may be configured to engage the mechanical clips such that the securing bar and the mechanical clip configured to secure a piece of plastic sheeting therebetween. In some aspects, the securing bar may include an engagement portion that is configured to engage the mechanical clip. In these aspects, the engagement portion and the mechanical clip may be configured to secure the piece of plastic sheeting therebetween.

In other aspects, a vapor mitigation apparatus for use with the construction of a building where the building has at least one penetration extending outward from a footing. In these aspects, the apparatus includes a membrane material and a rigid ring located at the approximate center of the membrane material. An inner portion of the membrane material is located inside the perimeter of the ring. The rigid ring is configured to be located around one of the at least one penetration such that the inner portion of the membrane material is configured to stretch around the one penetration resulting in the sealing of the apparatus to the penetration.

In some aspects, the inner portion may include an undersized hole located at the approximate center of the inner portion. The undersized hole is configured to allow the penetration to penetrate therethrough which allows the inner portion of the membrane material to stretch around the penetration creating a seal.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION OF THE INVENTION

Figure 1:
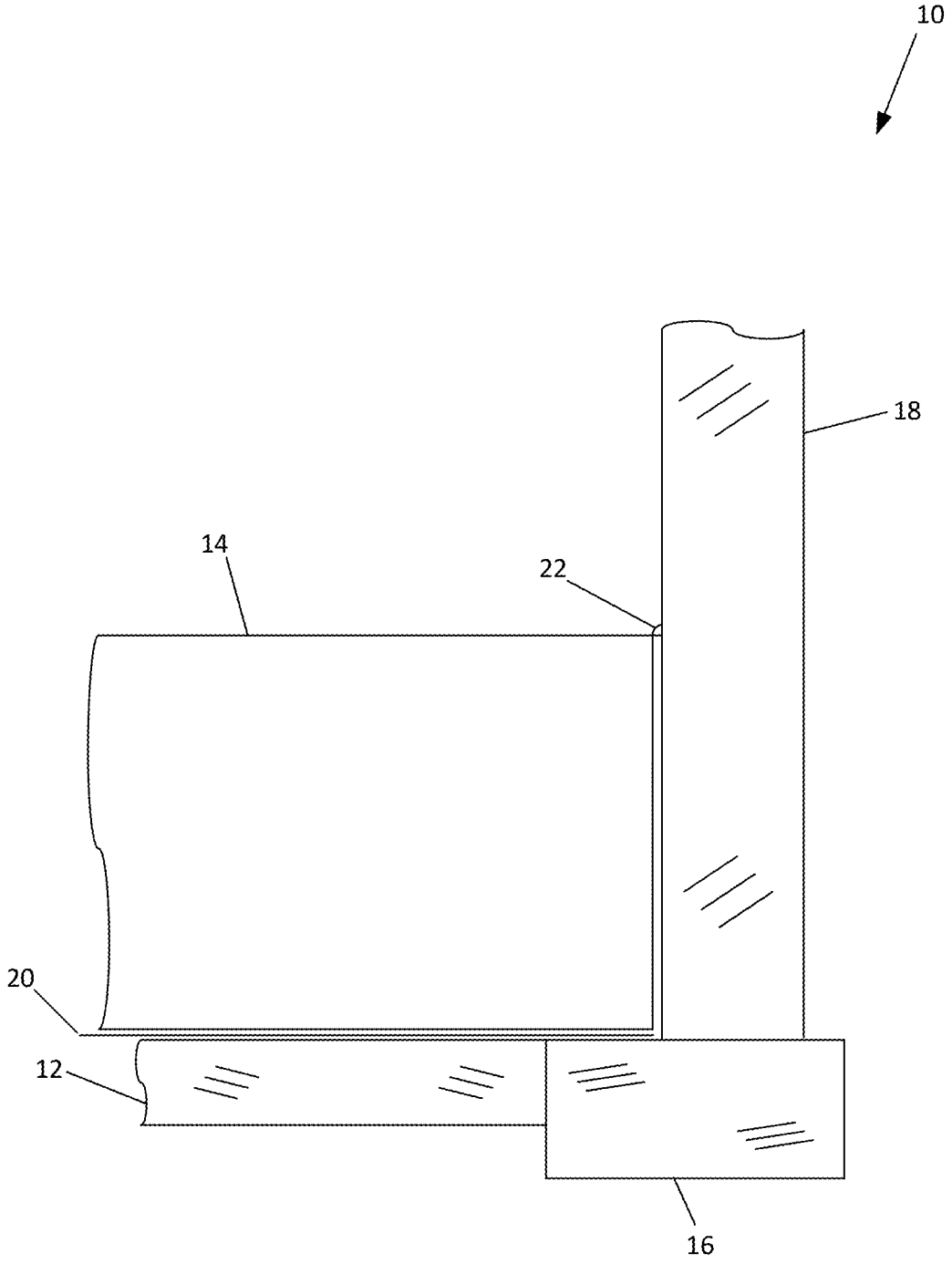
FIG. 1 is a cross-sectional view of a prior art system for radon gas control in a building.
Figure 2:
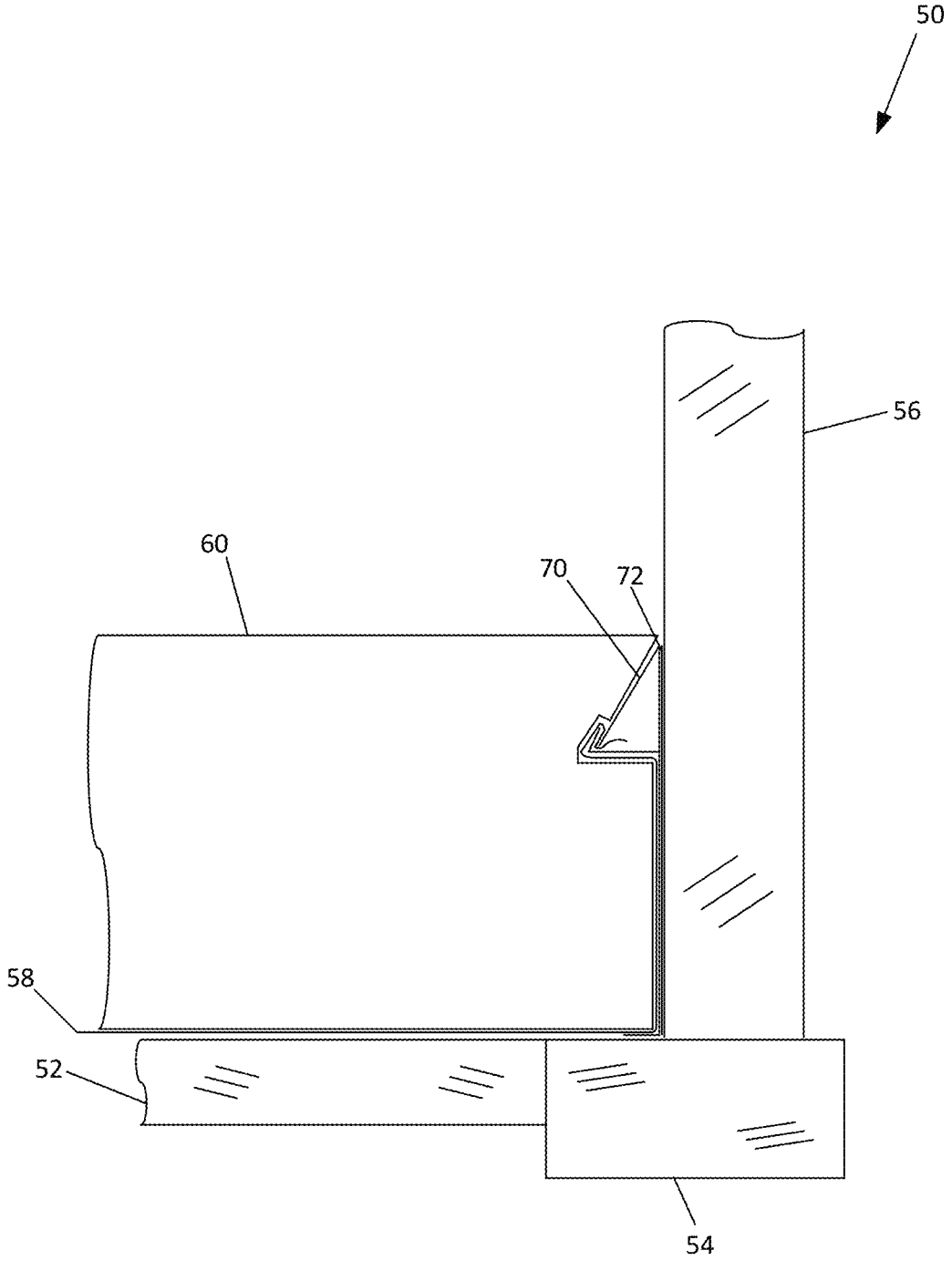
FIG. 2 is a cross-sectional view of an embodiment of the apparatus of the present invention in use within a building in a closed position.

FIG. 2 illustrates an embodiment of a schematic representation of an apparatus 70 of the present invention in use to reduce the amount of radon gas from seeping into a house. As illustrated, house includes a gas permeable layer 52 that is created below the building slab 60. Surrounding the gas permeable layer 52 are the building's footing 54 and foundation wall 56. A layer of plastic sheeting 58 is placed between the gas permeable layer 52 and the slab 60. The apparatus 70 is affixed to the foundation wall 56 by an adhesive 72 and rests against the footing 54. Further, the plastic sheeting 58 is secured to apparatus 70. When slab 60 is created by pouring cement over the footing 54, gas permeable layer 52, plastic sheeting 58 and foundation wall 56, the cement also encapsulates apparatus 70 therein. Thus, plastic sheeting 58 is maintained in place to create an airtight seal from radon leakage from the soil beneath the building. FIG. 2 illustrates some space between slab 60 and the footing 54, gas permeable layer 52, plastic sheeting 58, foundation wall 56, and apparatus 70. This is illustrative. When slab 60 is created, slab 60 will be directly against the footing 54, gas permeable layer 52, plastic sheeting 58, foundation wall 56 and apparatus 70. No space therebetween will remain.

Figure 3:
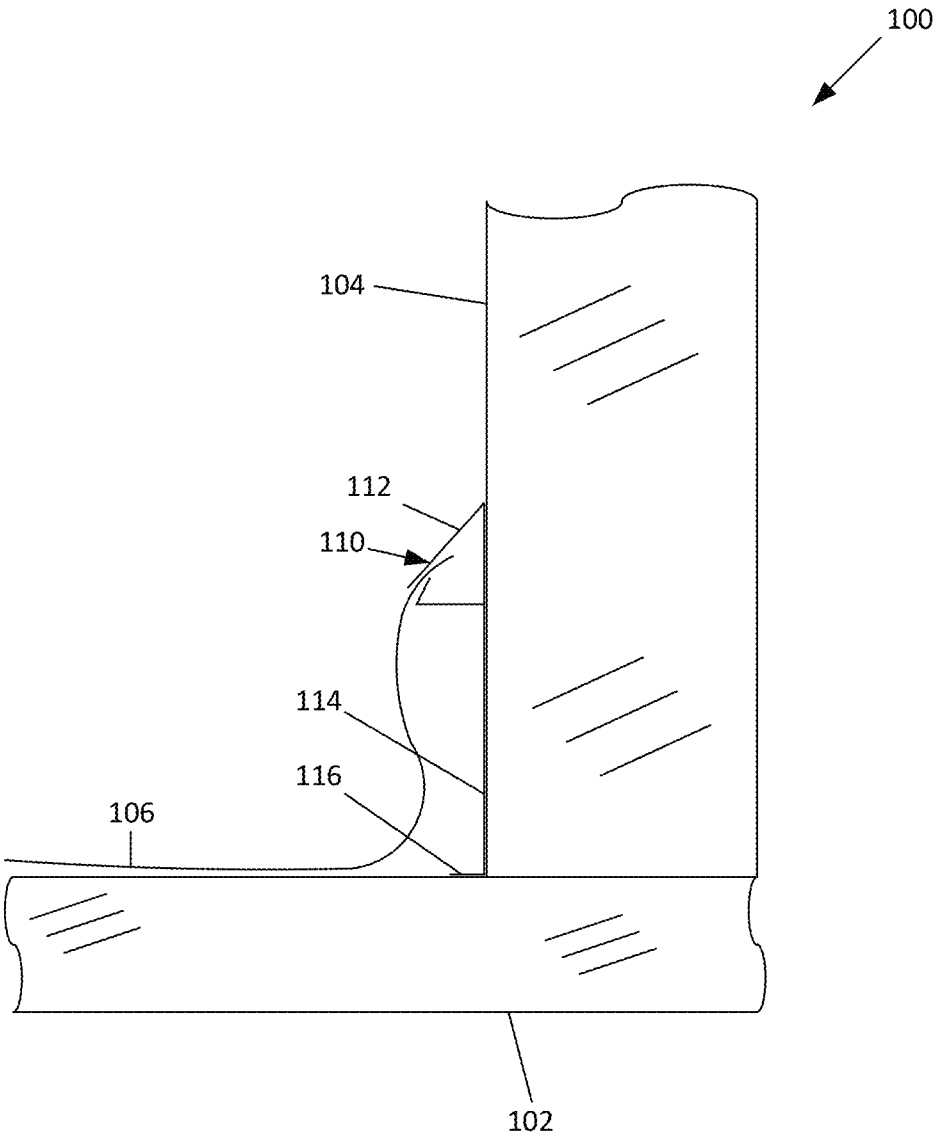
FIG. 3 is a cross-sectional view of an embodiment of the apparatus of the present invention in use within a building in an open position.
Figure 4:
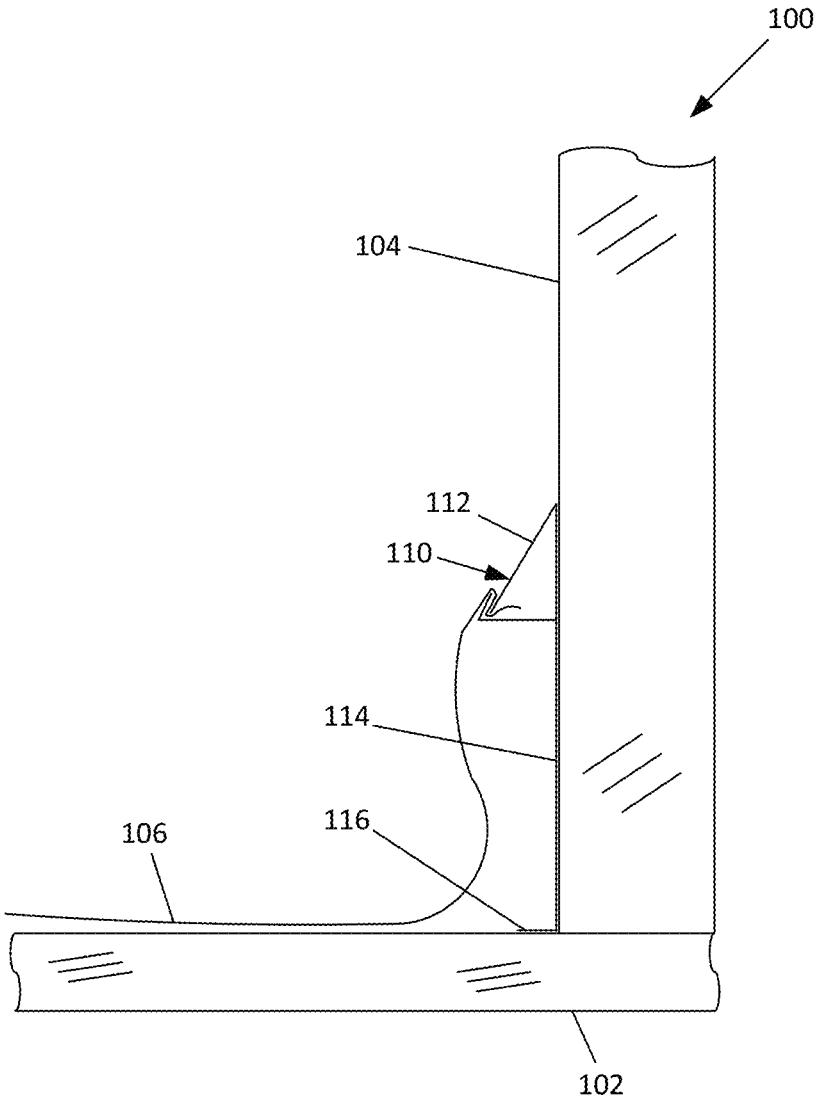
FIG. 4 is a cross-sectional view of an embodiment of the apparatus of the present invention in use within a building in a closed position.

As illustrated in FIGS. 3 and 4, an embodiment 100 of the apparatus 110 of the present invention is disclosed in use. Embodiment 100 includes a footing 102 supporting a foundation wall 104. A piece of plastic sheeting 106 is placed against footing 102, and between a gas permeable layer and concrete slab (not shown). Apparatus 110 may include a securing piece 114 which is affixed to foundation wall 104 by an adhesive, mechanical fastener or other fastener (not shown) sufficient to secure securing piece 114 to foundation wall 104. Apparatus 110 also includes a horizontal foot 116 extending away from the securing piece 114 at one end of securing piece 114. Horizontal foot 116 is configured to rest against footing 102.

Apparatus 110 also include a mechanical clip 112 that is configured to secure the plastic sheeting therein. Mechanical clip 112 is shown in an open position, see FIG. 3, and a closed position, see FIG. 4. In a locked, or closed, position, mechanical clip 112 secures the plastic sheeting 106 therein.

Concrete may be poured over apparatus 112 to create the building's slab. Due to the plastic sheeting 106 being secured to mechanical clip 112, the plastic sheeting does not move or otherwise pull away from the foundation wall 104 thereby creating an airtight seal between the ground and base of the house.

To assist with the creation of the slab, the length of securing piece 114 may be dimensioned as a gauge for the needed depth of the concrete. For example, if the concrete slab needs to be four (4) inches deep, the length of securing piece 114 may be four (4) inches.

Figure 7:
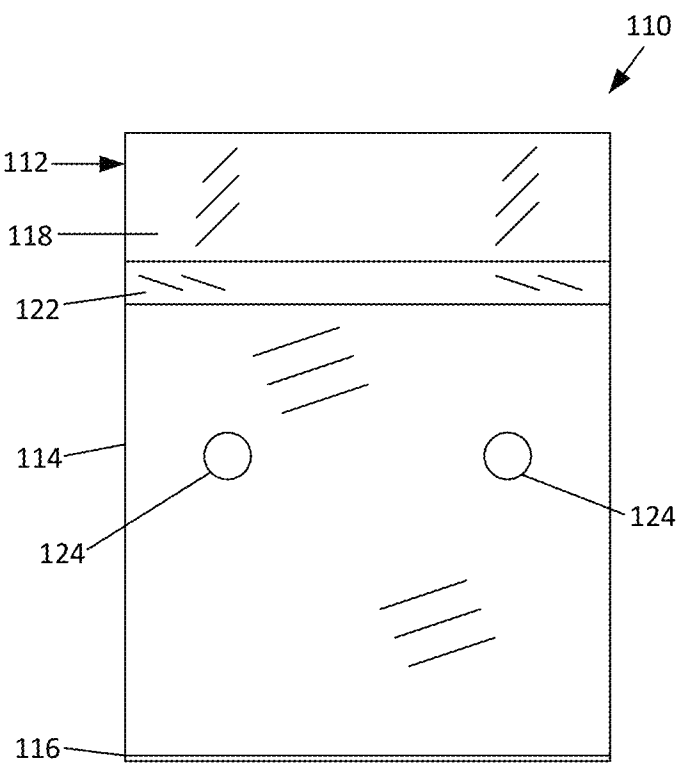
FIG. 7 is a front view of an embodiment of the apparatus of the present invention in a closed position.
Figure 6:
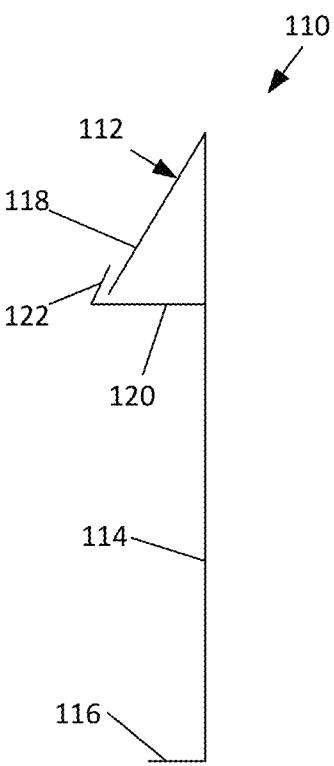
FIG. 6 is a cross-sectional view of an embodiment of the apparatus of the present invention in a closed position.
Figure 5:
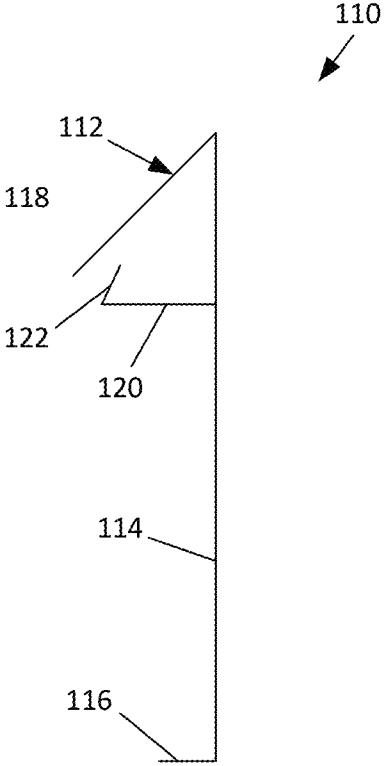
FIG. 5 is a cross-sectional view of an embodiment of the apparatus of the present invention in an open position.

As illustrated in FIGS. 5-7, an embodiment of the apparatus 110 of the present invention is disclosed. Apparatus 110 includes a securing piece 114, a horizontal foot 116 extending away from the securing piece 114 at one end of securing piece 114 and a mechanical clip 110 at the second end of securing piece 114. Mechanical clip 112 is shown in an open position, see FIG. 5, and a closed position, see FIG. 6. In a locked, or closed, position, mechanical clip 112 secures plastic sheeting therein. In this embodiment, mechanical clip 112 includes a base member 120 that extends substantially horizontally away from securing piece 114. The base member 120 has a locking portion 122 at its distal end. The mechanical clip 112 further includes a retention member 118 that configured to be depressed against the locking portion 122. In the locked, or closed, position the retention member 118 and locking portion 122 are configured to secure the piece of plastic sheeting therebetween.

As shown in FIG. 7, some embodiments may include openings 124 that may act as a guide for drilling fasteners, such as concrete screws, to secure apparatus 110 to a foundation wall or as a guide for the pouring of concrete when creating a slab. While these embodiments may use fasteners to secure apparatus 110 to a foundation wall, those skilled in the art will recognize that apparatus 110 may be securing to a foundation wall by other sufficient means, such as adhesives.

Figure 9:
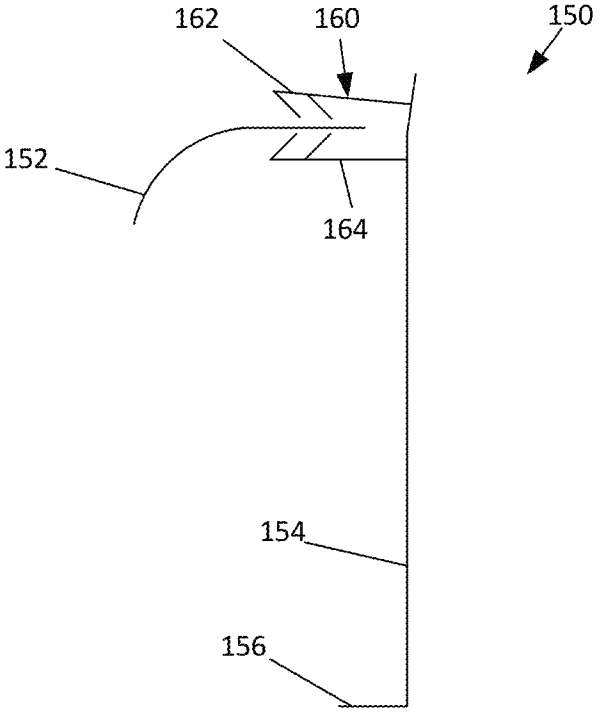
FIG. 9 is a cross-sectional view of an additional embodiment of the apparatus of the present invention in an open position.
Figure 8:
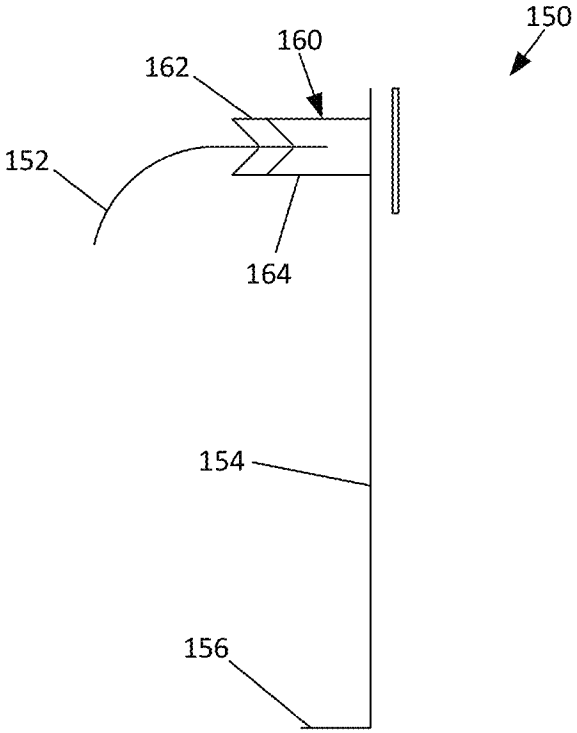
FIG. 8 is a cross-sectional view of an additional embodiment of the apparatus of the present invention in a closed position.

As illustrated in FIGS. 8-9, an additional embodiment of the apparatus 150 of the present invention is disclosed. Apparatus 150 includes a securing piece 154, a horizontal foot 156 extending away from the securing piece 154 at one end of securing piece 154 and a mechanical clip 160 at the second end of securing piece 154. Mechanical clip 160 is shown in a closed position, see FIG. 8, and an open position, see FIG. 9. In a locked, or closed, position, mechanical clip 160 secures plastic sheeting 152 therein. In this embodiment, mechanical clip 160 includes a first jaw member 162 and a second jaw member 164 that is hinged to the first jaw member 162. In this embodiment, a first jaw member 162 and a second jaw member 164 extend substantially horizontally away from securing piece 154. In the locked, or closed, position, the first jaw member 162 and second jaw member 164 are configured to secure the piece of plastic sheeting 152 therebetween.

Figure 11:
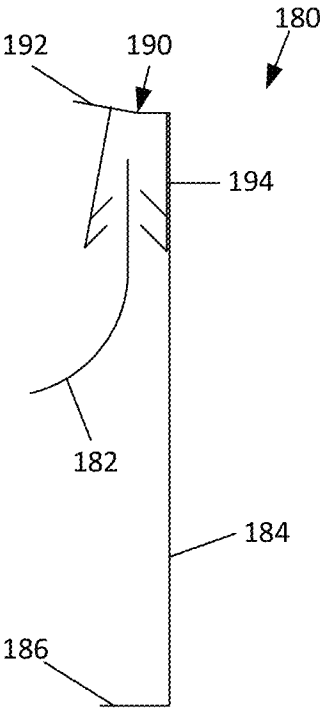
FIG. 11 is a cross-sectional view of an additional embodiment of the apparatus of the present invention in an open position.
Figure 10:
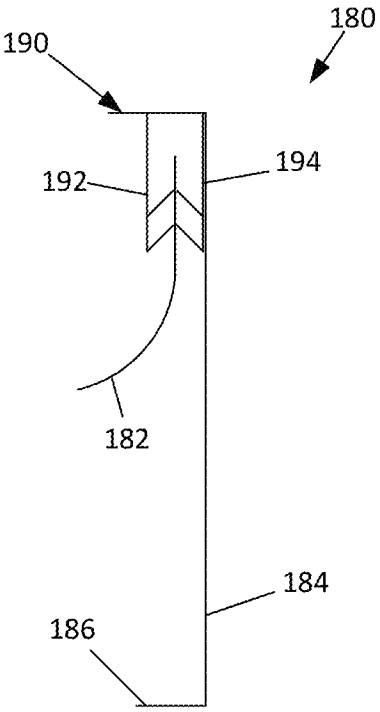
FIG. 10 is a cross-sectional view of an additional embodiment of the apparatus of the present invention in a closed position.

As illustrated in FIGS. 10-11, an additional embodiment of the apparatus 180 of the present invention is disclosed. Apparatus 180 includes a securing piece 184, a horizontal foot 186 extending away from the securing piece 184 at one end of securing piece 184 and a mechanical clip 190 at the second end of securing piece 184. Mechanical clip 190 is shown in a closed position, see FIG. 10, and an open position, see FIG. 11. In a locked, or closed, position, mechanical clip 190 secures plastic sheeting 182 therein. In this embodiment, mechanical clip 190 includes a first jaw member 192 and a second jaw member 194 that is hinged to the first jaw member 192. In this embodiment, a first jaw member 192 and a second jaw member 194 are positioned substantially vertically next to securing piece 184. In the locked, or closed, position, the first jaw member 192 and second jaw member 194 are configured to secure the piece of plastic sheeting 182 therebetween.

Figure 14:
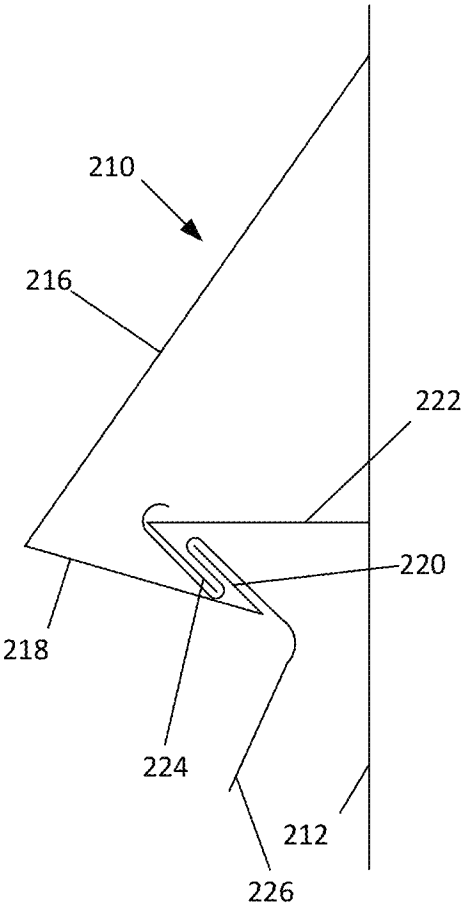
FIG. 14 is a cross-sectional view of an additional embodiment of the apparatus of the present invention in a closed position in use with a piece of sheeting.
Figure 13:
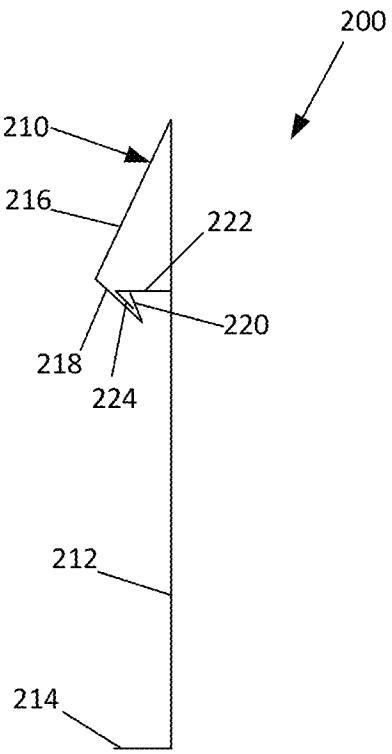
FIG. 13 is a cross-sectional view of an additional embodiment of the apparatus of the present invention in a closed position.
Figure 12:
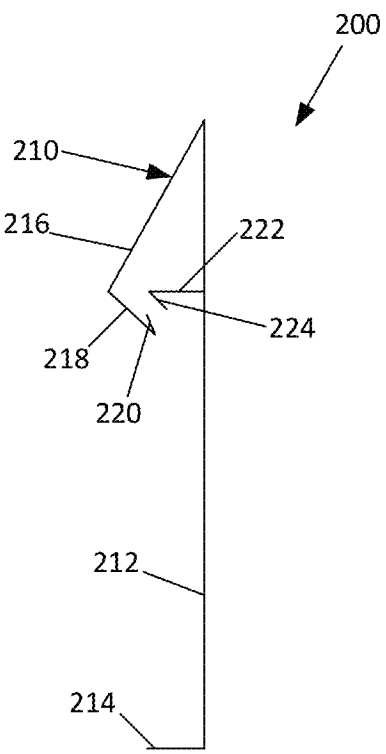
FIG. 12 is a cross-sectional view of an additional embodiment of the apparatus of the present invention in an open position.

As illustrated in FIGS. 12-14, an additional embodiment of the apparatus 200 of the present invention is disclosed. Apparatus 200 includes a securing piece 212, a horizontal foot 214 extending away from the securing piece 212 at one end of securing piece 212 and a mechanical clip 210 at the second end of securing piece 212. Mechanical clip 210 is shown in an open position, see FIG. 12, and a closed position, see FIGS. 13 and 14. In a locked, or closed, position, mechanical clip 210 secures plastic sheeting 226 therein. In this embodiment, mechanical clip 210 includes a base member 222 that extends substantially horizontally away from securing piece 212. The base member 222 has a first locking portion 224 at its distal end. The mechanical clip 210 further includes a retention member 216 having a second locking portion 218 at its distal end. Retention member 216 is configured to be depressed against base member 222 such that the first locking portion 224 interlock with the second locking portion 218. In the locked, or closed, position the retention member 216 and base member 222 are configured to secure the piece of plastic sheeting 226 therebetween.

Figure 17:
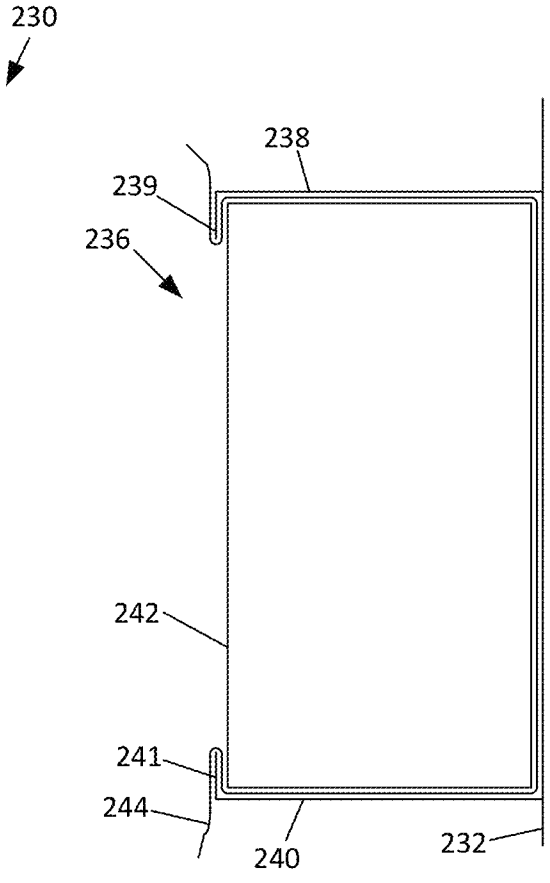
FIG. 17 is a cross-sectional view of an additional embodiment of the apparatus of the present invention in a closed position in use with a piece of sheeting.
Figure 16:
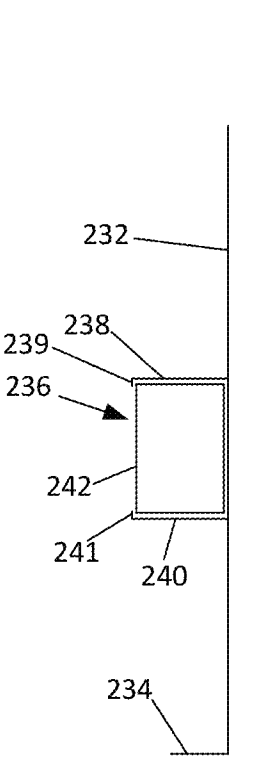
FIG. 16 is a cross-sectional view of an additional embodiment of the apparatus of the present invention in a closed position.
Figure 15:
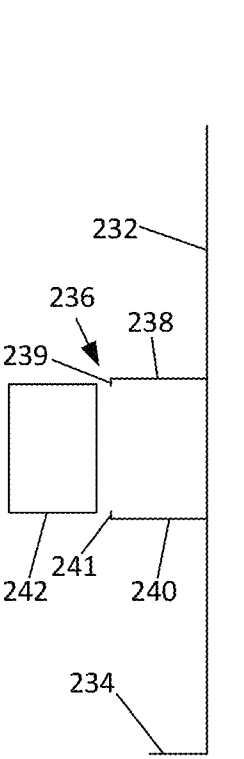
FIG. 15 is a cross-sectional view of an additional embodiment of the apparatus of the present invention in an open position.

As illustrated in FIGS. 15-17, an additional embodiment of the apparatus 230 of the present invention is disclosed. Apparatus 230 includes a securing piece 232, a horizontal foot 234 extending away from the securing piece 232 at one end of securing piece 234 and a mechanical clip 236 extending away from the securing piece 232. Mechanical clip 236 is illustrated extending away from securing piece at approximately the center portion thereof. This is illustrative and not meant to be limiting. Those skilled in the art will recognize that the placement of mechanical clip 236 may be located at any location along securing piece 232. Mechanical clip 236 is shown in an open position, see FIG. 15, and a closed position, see FIGS. 16 and 17. In a locked, or closed, position, mechanical clip 236 secures plastic sheeting 244 therein.

In this embodiment, mechanical clip 236 includes a securing bar 242 being held in place by an upper retention member 238 having an upper retention end 239 and a lower retention member 240 having a lower retention end 241. Securing bar 242 is illustrated in a square cross-sectional configuration. This is illustrative and not meant to be limiting. Those skilled in the art will recognize that other cross-sectional configurations, such as rectangular and circular, are within the scope of this disclosure. Securing bar 242 is configured to slide, or otherwise be received between upper retention member 238 and lower retention member 240. Securing bar 242 is locked in place by upper retention end 239 and lower retention end 241.

In operation, as shown in FIG. 17, a sheet of plastic sheeting 244 is held in place between securing bar 242 and upper retention member 238 and lower retention member 240.

Figure 18:
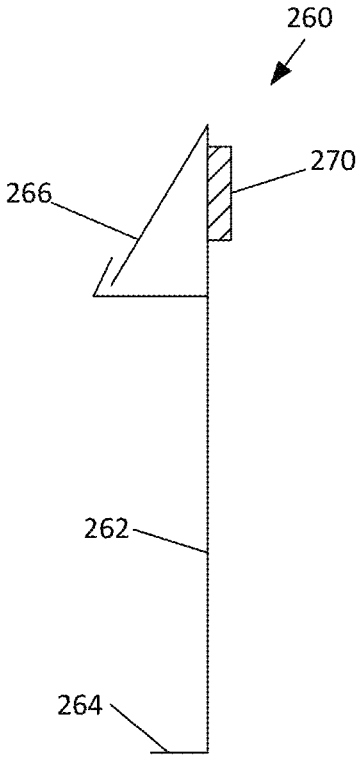
FIG. 18 is a cross-sectional view of an additional embodiment of the apparatus of the present invention in a closed position in use with a piece of wall gasket.

As illustrated in FIG. 18, an additional embodiment of the apparatus 260 of the present invention is disclosed. Apparatus 260 includes a securing piece 262, a horizontal foot 264 extending away from the securing piece 262 at one end of securing piece 264 and a mechanical clip 266 extending away from the securing piece 262. This embodiment also includes a gasket 270 is affixed to the foundation wall side of the securing piece 262 and is in communication with the foundation wall. Gasket 270 may be affixed to the foundation wall by an adhesive, glue or other fastening agents and/or may be secured by pressure exerted by the securing piece. Gasket 270 acts as a barrier for any gas that may try to escape into occupied living areas of the building from between the gas permeable layer, plastic sheeting, securing piece 262 and the foundation wall. Gasket 270 which may be constructed from a foam or other material that is flexible so as to conform to the surface of the foundation wall and also be able to be secured to the securing piece 262.

Figure 19:
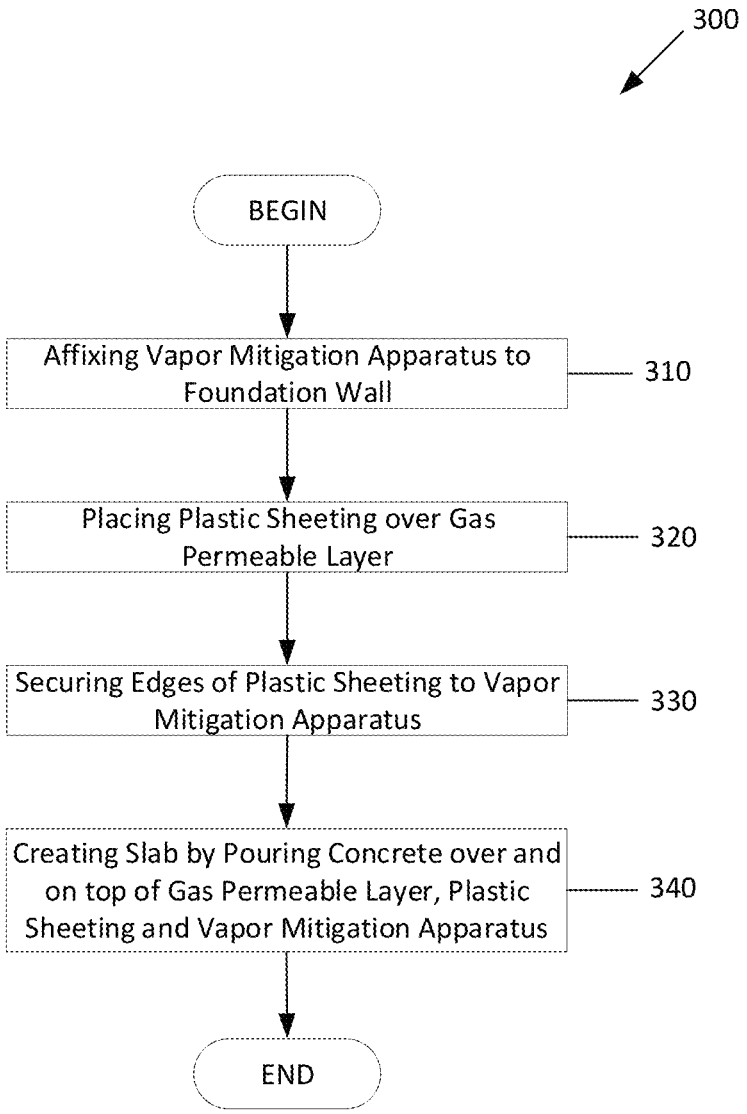
FIG. 19 is a flow chart of an embodiment of the method of the present invention.

As illustrated in FIG. 19, In one aspect, a method 300 for vapor mitigation in the construction of a building is disclosed. The method includes utilizing a vapor mitigation apparatus 110, as set out above, having a vertical securing piece 114, a horizontal foot 116 located at one end of the securing piece 114 and extending away from the securing piece 114, and a mechanical clip 112 located at the second end of the securing piece 114 and is configured to secure a piece of plastic sheeting 106 thereto. The method includes affixing the vertical securing piece to the circumference of a foundation wall that surround a gas permeable layer such that the horizontal foot rests on the footing that supports the foundation wall (block 310). A piece of plastic sheeting is placed over the gas permeable layer (block 320). The edges of the plastic sheeting are secured to the mechanical clip thereby creating a vapor barrier over the gas permeable layer (block 330). A slab of concrete is created by pouring a sufficient amount of concrete over the vapor mitigation apparatus 100 and plastic sheeting 106 (block 340).

As illustrated in FIGS. 20-23, an additional embodiment of the apparatus 300 of the present invention is disclosed. Apparatus 300 includes a securing piece 302 and a securing bar 310. Securing piece 302 includes a horizontal foot 304 extending away from the securing piece 302 at one end of securing piece 302 and a mechanical clip 306 extending away from the securing piece 302. Mechanical clip 306 is illustrated extending away from securing piece in an approximate u-shape relative to securing piece 302. Securing piece 302 is configured to be affixed to a foundation wall (not shown) by an adhesive, mechanical fastener or other fastener (not shown) sufficient to secure securing piece 302 to the foundation wall. Horizontal foot 304 is configured to rest against a footing.

Securing bar 310 includes an engagement portion 312. Securing bar 310 is configured to be placed over the mechanical clip 306 of the securing piece 302, such that the engagement portion 312 engages with the mechanical clip 306, locking the two components together.

Figure 22:
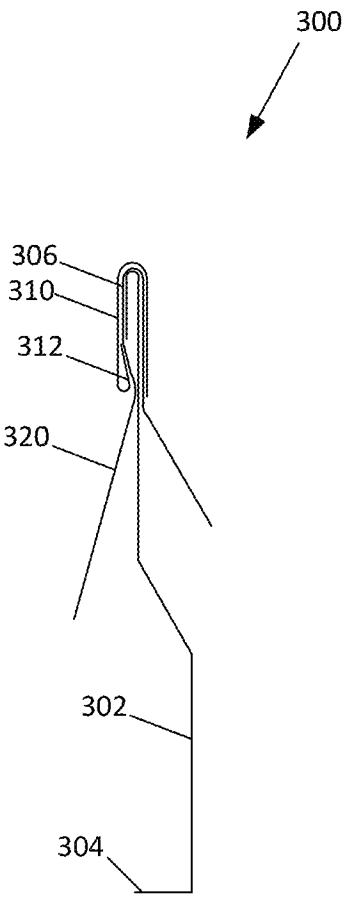
FIG. 22 is a cross-sectional view of an additional embodiment of the apparatus of the present invention in a closed position in use with a piece of sheeting.
Figure 21:
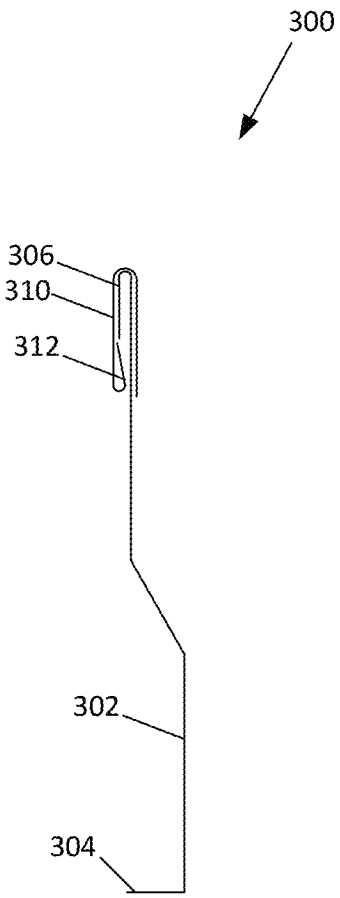
FIG. 21 is a cross-sectional view of an additional embodiment of the apparatus of the present invention in a closed position.
Figure 20:
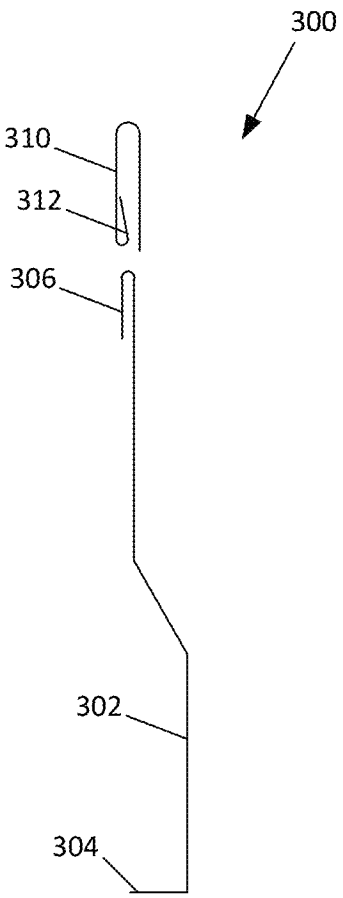
FIG. 20 is a cross-sectional view of an additional embodiment of the apparatus of the present invention in an open position.
Figure 23:
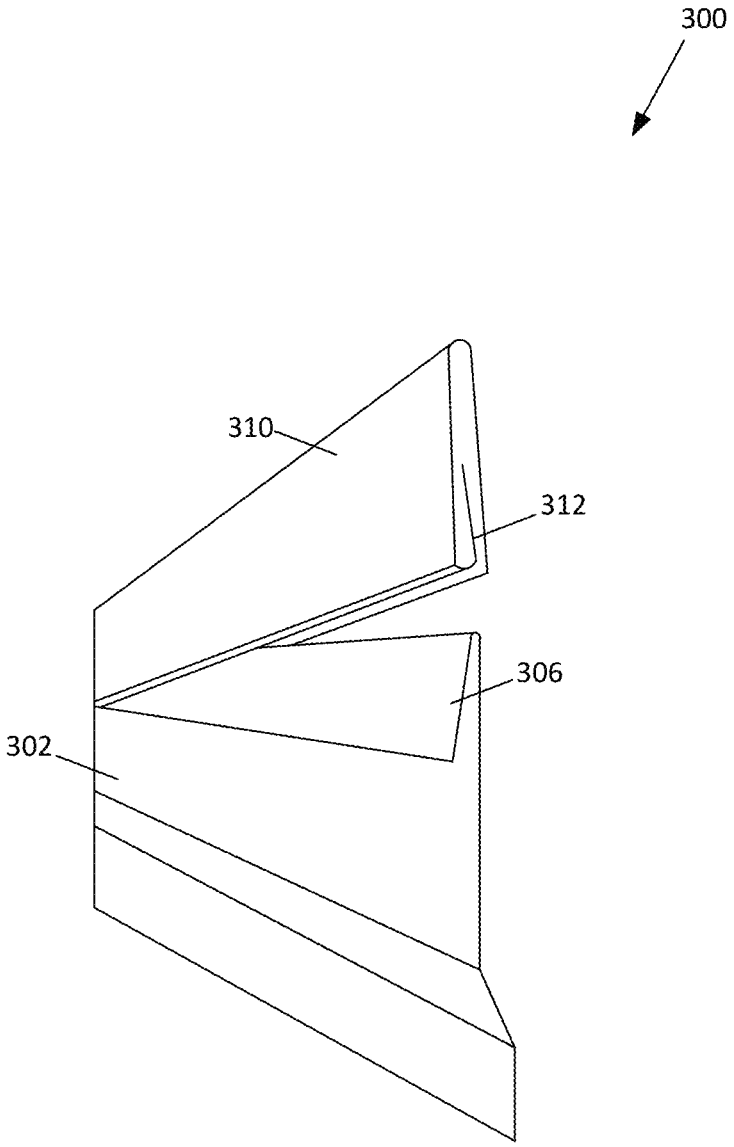
FIG. 23 is a perspective view of an additional embodiment of the apparatus of the present invention in a partially open and partially closed position.

In operation, as shown in FIG. 22, a sheet of plastic sheeting 320 is placed between the securing bar 310 and the mechanical clip 306 of the securing piece 302. The securing bar 310 is pressed down over the securing piece 302 such that the engagement portion 312 engages with the mechanical clip 306, locking the two components together. This results in the sheet of plastic sheeting 320 being held in place therebetween.

Figure 24:
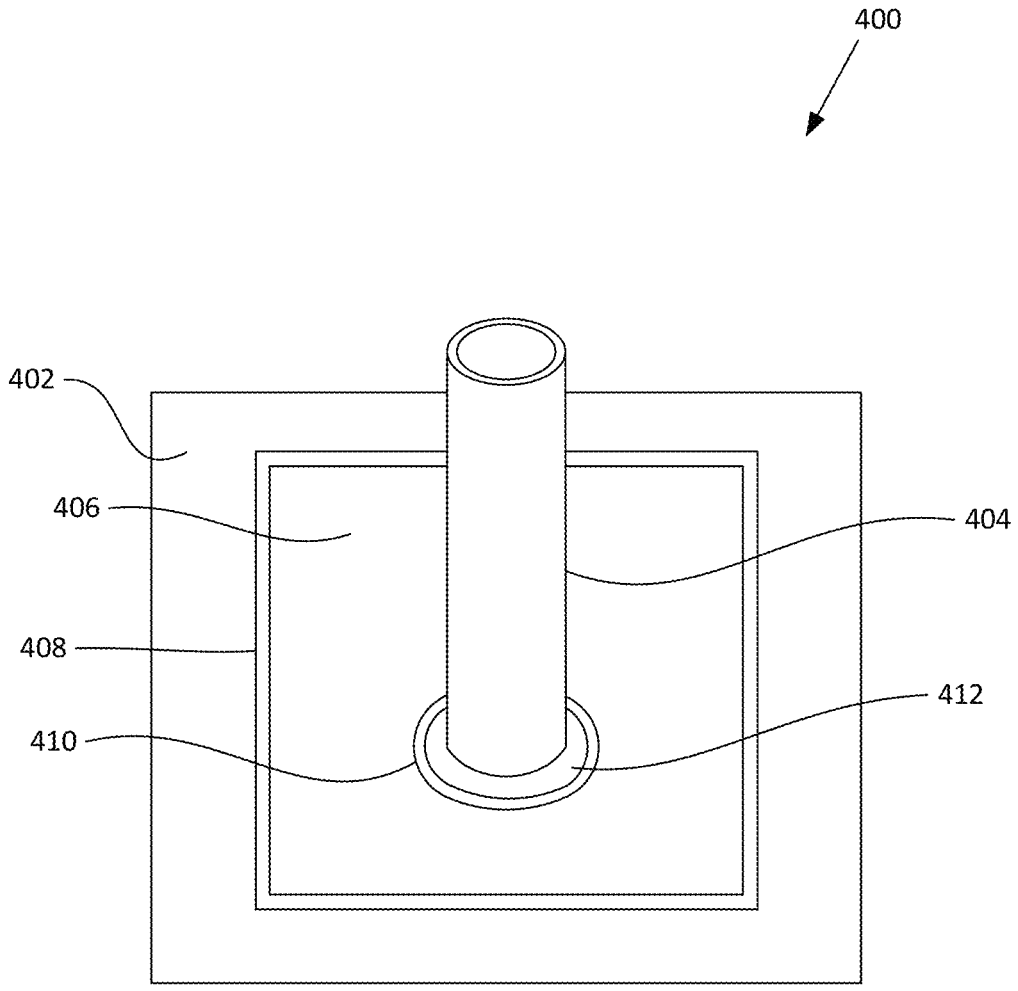
FIG. 24 is a perspective view of an additional embodiment of the apparatus of the present invention surrounding an item of penetration.
Figure 25:
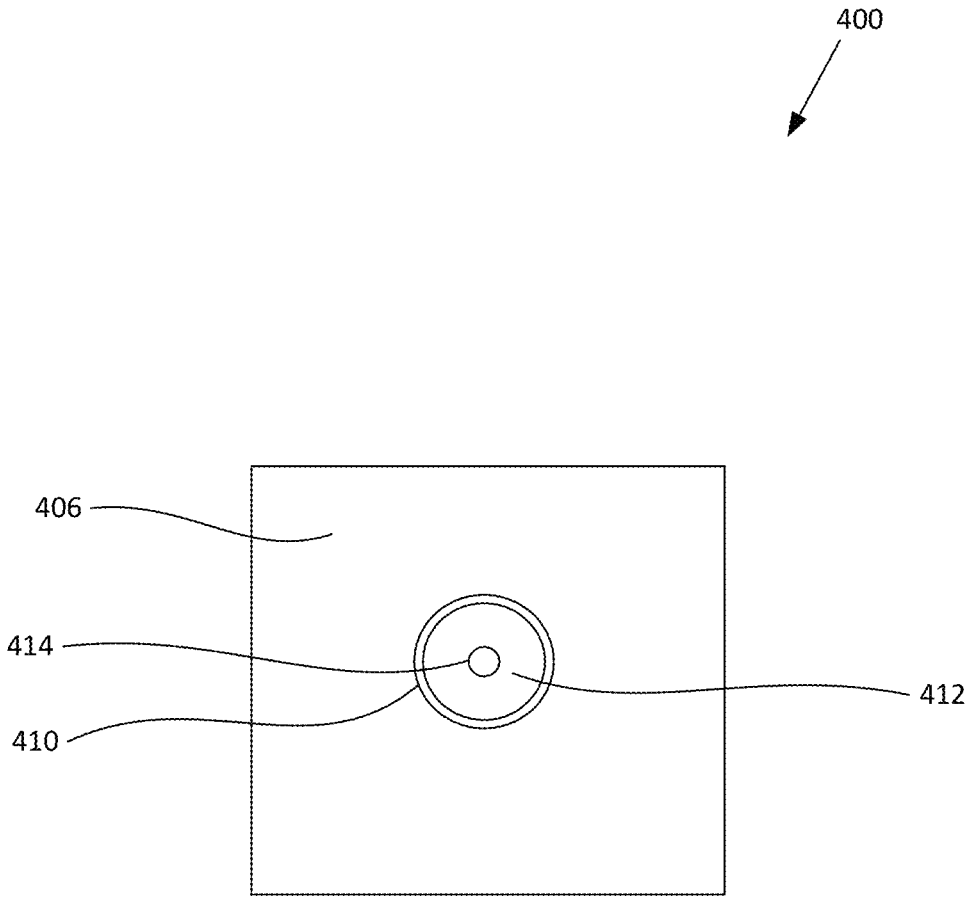
FIG. 25 is a top view of an additional embodiment of the apparatus of the present invention.

As illustrated in FIGS. 24-25, an additional embodiment of the apparatus 400 of the present invention is disclosed. Apparatus 400 is configured to address the issue of gas leakage around penetrations located within the footing area of foundations, crawlspaces or monolithic slabs on grade. Apparatus 400 includes a semi-flexible membrane material 406 and a rigid ring 410 located at the approximate center of the membrane material 406. An inner portion 412 of the membrane material 406 is located on the inside of the ring 410. An undersized hole 414 in the centre of the ring. The inclusion of an undersized hole 414 is illustrative and not meant to be limiting. Some embodiments may not include a pre-cut undersized hole 414 but rather provide a complete inner portion 412. These embodiments allow for the user to cut a custom size hole depending size of the penetration or other needs.

The membrane material 406 is secured to a Radon membrane 402 located beneath the apparatus 400. The membrane material may be any type of plastic sheet, membrane, film or other continuous polymeric material that is used to separate areas or volume to act as a barrier. In this embodiment, membrane material 406 is securing to the Radon membrane 402 with an adhesive tape 408. However, any sufficient fastener may be used and is within the scope of the present invention.

Ring 410 may be a single piece ring or a multi-piece ring and constructed from or made from any material, to be any size or shape depending on the size of the penetration 404. The circumference of ring 410 is to be larger than the diameter/perimeter of the penetration 404.

Ring 410 is placed over the penetration 404 and pulled down to where the base of penetration meets the permeable layer, within the footing area. The undersized hole 414 in the inner portion 412 of the membrane material 406 is allowed to stretch and seal around the penetration 404.

The ring 410 may be fused or mechanically locked to the membrane material 406. Ring 410 allows the inner portion 412 to be held in an elastic state which promotes the stretch and seal around the penetration 404. Further, ring 410 allows the user to have a handhold in order to evenly apply downward pressure of the apparatus 400 overtop of penetration 404 ensuring a uniform stretch and seal fit, thus preventing ripping or tearing due to uneven applied pressure.

Figure 26:
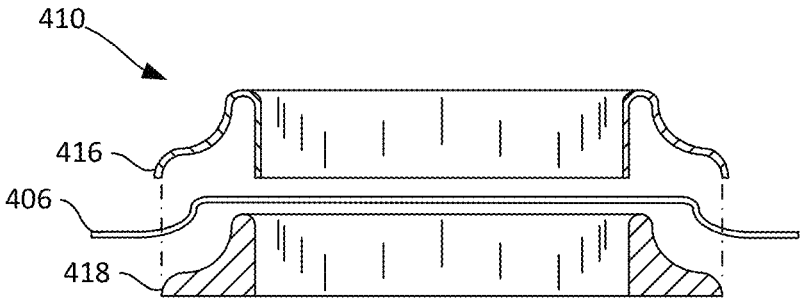
FIG. 26 is a cross-sectional side view of an embodiment of the rigid ring of the present invention.

In some embodiments, as illustrated in FIG. 26, the ring 410 may include a lower ring portion 418 and an upper ring portion 416. The lower ring portion 418 is located on the underside of the membrane material 406. The upper ring portion 416 is positioned on the upper side of the membrane material 406 and over the lower ring portion 418. The upper ring portion 416 is configured to engage and lock with the lower ring portion 418. The use of an upper portion and lower portion is illustrative and not meant to be limiting. Those skilled in the art will recognize that the rigid ring 410 may be secured to the membrane material 406 through the use of various fastening methods and materials, include but not limited to adhesives and mechanical locking components, and as such, all are within the scope of the present invention.

In operation, the Radon membrane 402 is installed over a granular fill and over the penetration 404. The outside perimeter edges of the Radon membrane 402 may be secured to a foundation wall with one of the embodiments set out above. Apparatus 400 is placed over the penetration 404, such that ring 410 is positioned around the penetration 404 where the center of the undersized hole 414 of the inner portion 412 is aligned with the center of the penetration 404. Downward pressure is then applied to the ring 410, thus stretching the inner portion 412 around the penetration 404, resulting in the sealing of the apparatus 400 to the penetration. The edges of the membrane material 406 is then sealed to the Radon membrane 402 forming a complete seal.

Figure 27:
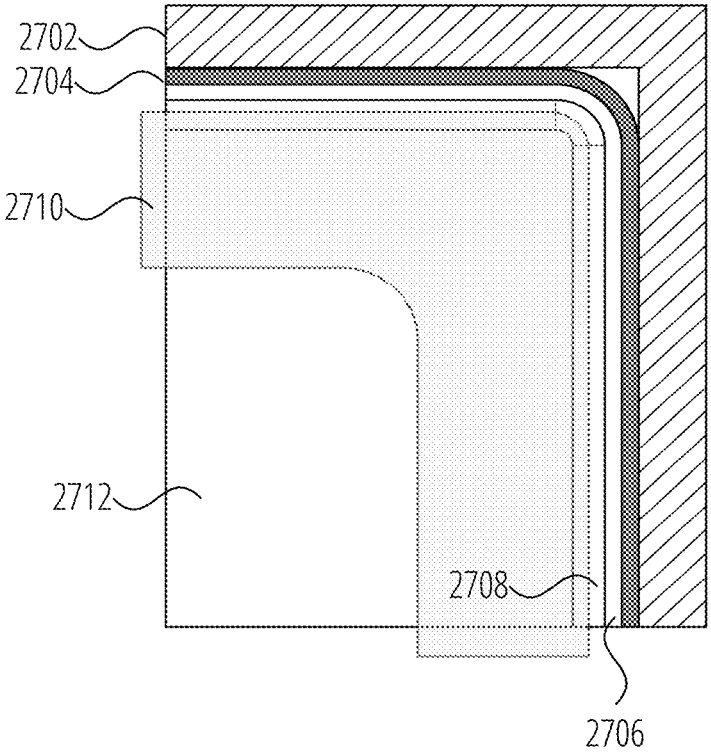
FIG. 27 illustrates a top view of an additional embodiment of the apparatus of the invention.

FIG. 27 is a top view of an additional embodiment of apparatus of the invention. This figure shows the relative positioning of the apparatus of an embodiment of the invention in relation to footing 2712 and foundation wall 2702 when installed. The vertical member 2706 abuts the foundation wall 2702, spaced apart by means of a gasket 2704. The gasket 2704 provides a gas tight seal between the vertical member 2706 and the foundation wall 2702 when the concrete flooring (not shown) is poured in place. The corner sections if embodiments of the invention may be rounded, as shown, or square exactly following the contours of the foundation wall 2702. The foot 2708 helps to stabilize the vertical member 2706 during installation. The foot 2708 is situated at the lower edge of the vertical member 2706 and may extend either away from the foundation wall 2702, as shown, or towards the foundation wall 2702 (not shown). The plastic sheeting or membrane 2710 is attached to the vertical member 2706 and extends part way across the footing 2712. The plastic sheeting or membrane 2710 is then attached to a plastic sheeting or membrane that covers the entire footing 2712 using tape, such as Tuck tape.

Figure 28:
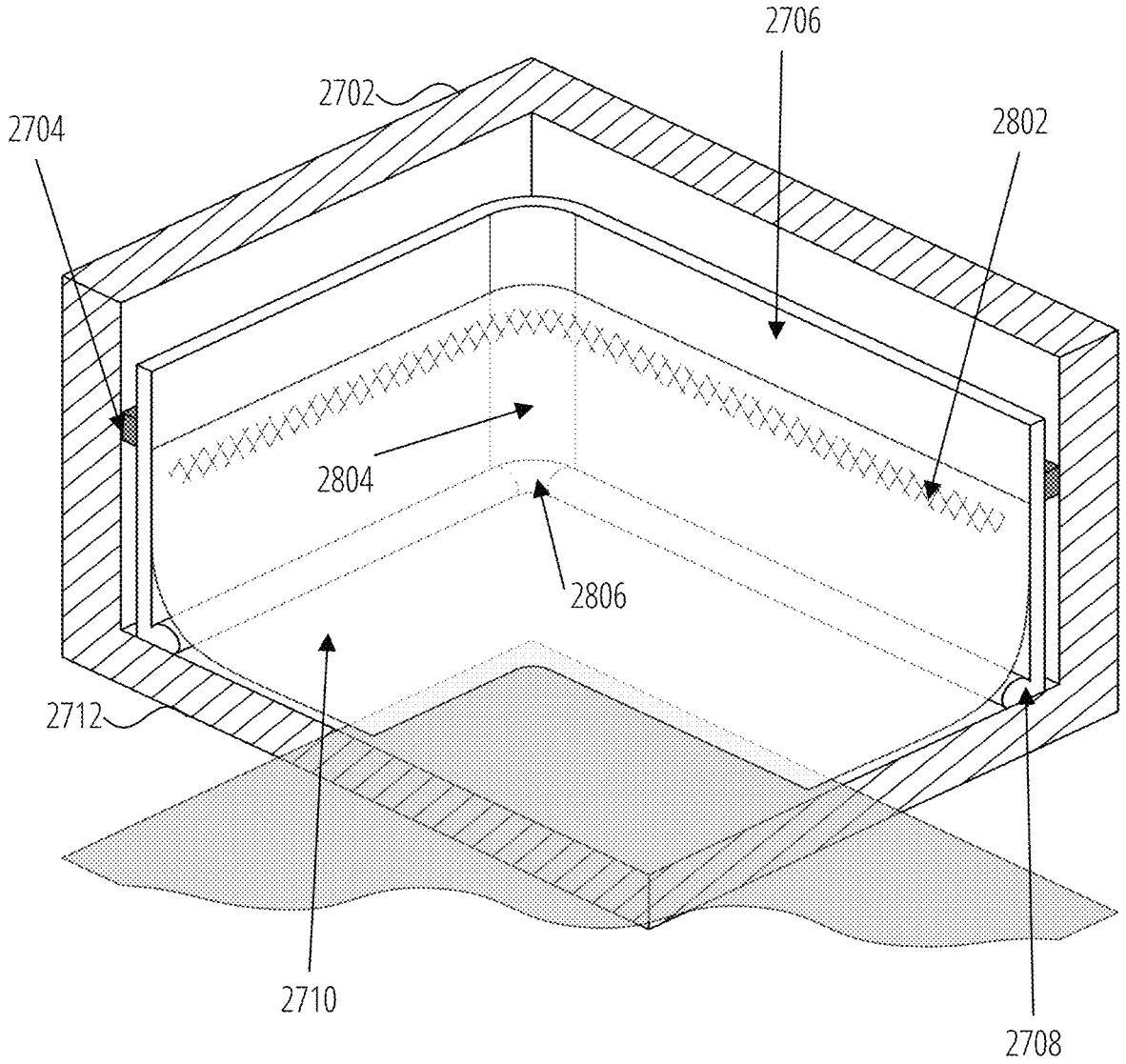
FIG. 28 illustrates a perspective view of an additional embodiment of the apparatus of the invention.

FIG. 28 is a perspective view of an additional embodiment of apparatus of the invention also showing the relative positioning of the apparatus in relation to footing 2712 and foundation wall 2702 when installed. In the embodiment as shown, the plastic sheeting or membrane 2710 is attached to the front face of the vertical member 2706 approximately at the same level as the gasket 2704. It is contemplated that the plastic sheeting or membrane 2710 may be attached to the vertical member 2706 above or below the level of the gasket 2704. The length of plastic sheeting or membrane 2710 may be permanently fixed and sealed to the vertical member 2706 or flange section along the entire length of the apparatus. The width of material attached to the vertical member 2706 or flange is indiscriminate, but will be fixed the entire length of the device, (i.e. 8 ft, 12 ft. etc.). Securing and sealing the plastic sheeting or membrane 2710 to the device may be accomplished by various means of attachment 2802, but not limited to: gluing, welding, solvent welding, hot melt glue, etc. Although the vertical member 2706 of the apparatus is most feasibly made from a type of poly vinyl, cladding, ABS, or plastic, the material type could comprise a broad spectrum of materials.

Figure 29:
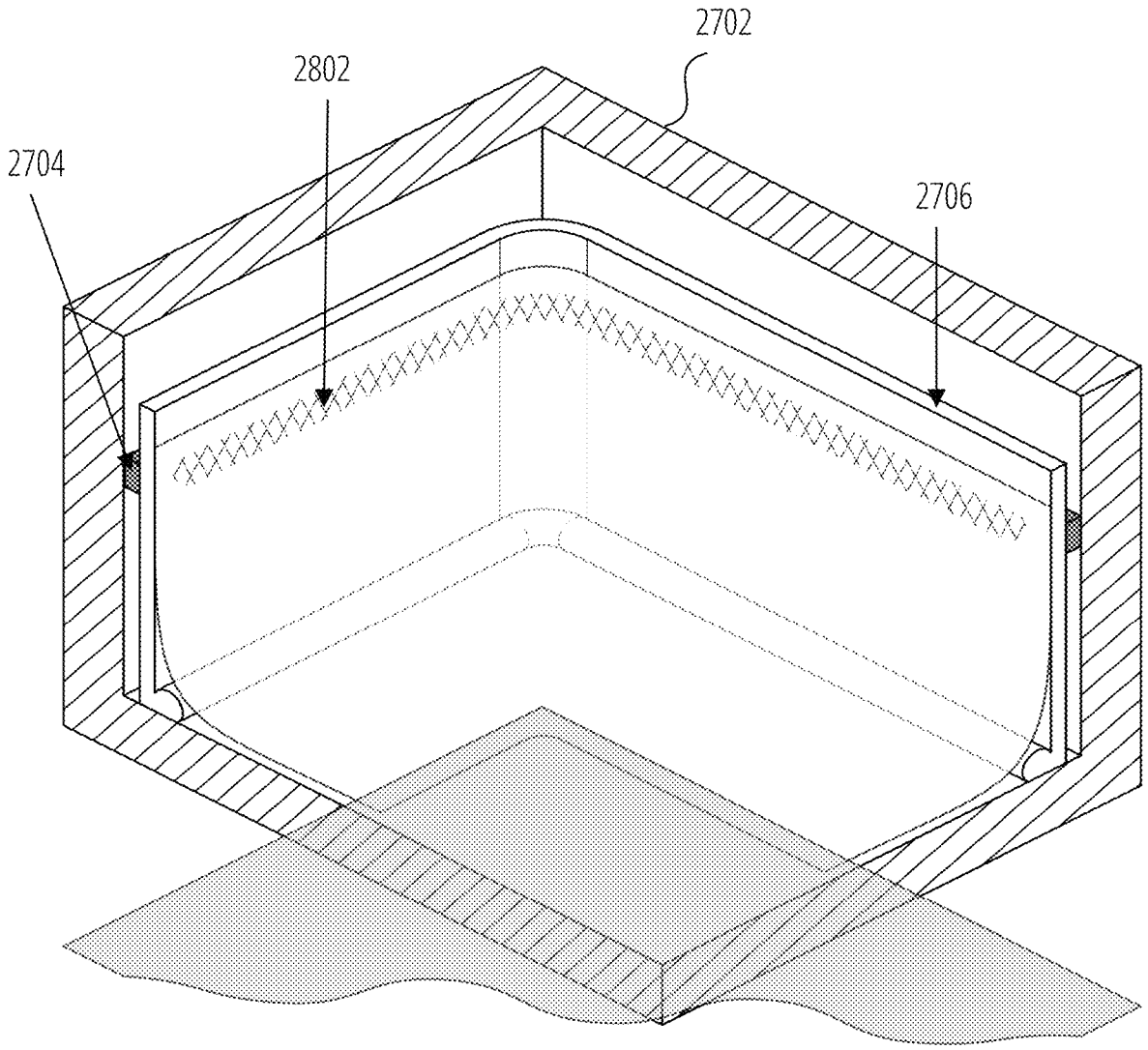
FIG. 29 illustrates a perspective view of an additional embodiment of the apparatus of the invention.

FIG. 29 is a perspective view of an additional embodiment of apparatus of the invention also showing the relative positioning of the apparatus in relation to footing 2712 and foundation wall 2702 when installed. In the embodiment as shown, the plastic sheeting or membrane 2710 is attached to the front face of the vertical member 2706 above the level of the gasket 2704. Again, the length of plastic sheeting or membrane 2710 is permanently fixed and sealed to the vertical member 2706 or flange section along the entire length of the apparatus.

Figure 30:
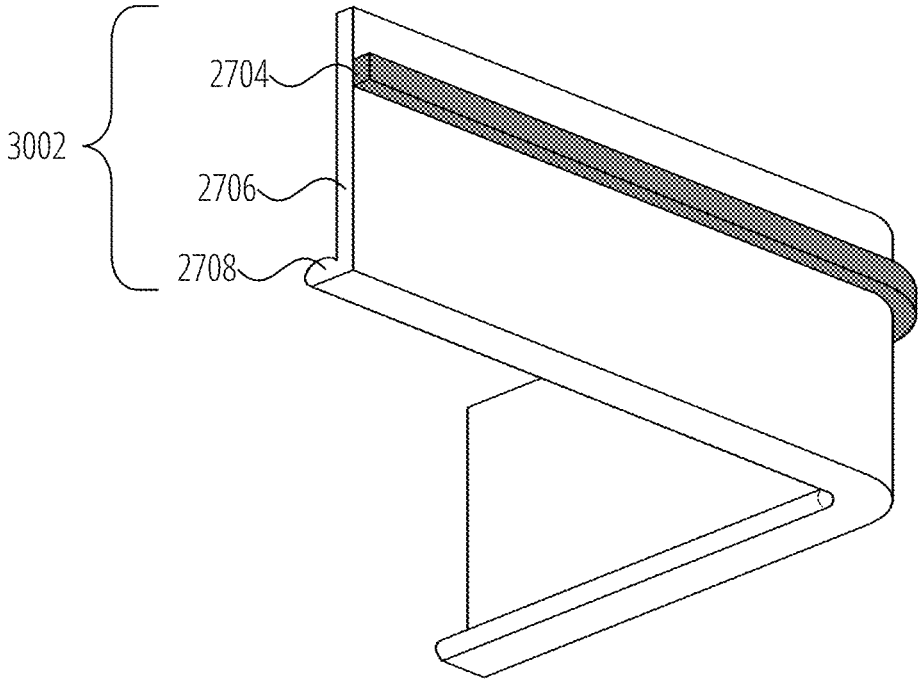
FIG. 30 illustrates a top perspective of an aspect of an embodiment of the apparatus of the invention.

FIG. 30 is a 3D perspective view of an embodiment of the apparatus 3002 of the invention. In this embodiment, the foot 2708 extends forward beyond the front face of the vertical member 2706 or flange. In other embodiments the foot 2708 may be a different shape and it may extend beyond the back face of the vertical member 2706 or flange. It is also contemplated that an embodiment of the apparatus 3002 of the invention can be installed on the outside of the foundation wall. In this embodiment the apparatus will wrap around the exterior of a building or structure forming an air tight seal. Securing the apparatus to the outer surface of the walls will prevent ground gasses from penetrating laterally. The footing membrane can again be sealed to the plastic sheeting by means known to a worker skilled in the art. As with the apparatus being installed upon the footing in a basement with mechanical fasteners such as: nails, screws, RAMSET concrete nails, etc, below the gasket; the installation of the device on the exterior wall can be fastened in the same manner. Once this device is secured and installed at a predetermined height, the worker can connect the wall membrane to the membrane of the apparatus by means of a form of Tape (Tuck Tape), thus creating a sealed curtain around the perimeter of the structure. Once completed and verified, backfilling of the ground substrate can secure the wall membrane in place against the foundation wall creating a sealed and impenetrable barrier from lateral ground gasses.

Figure 31:
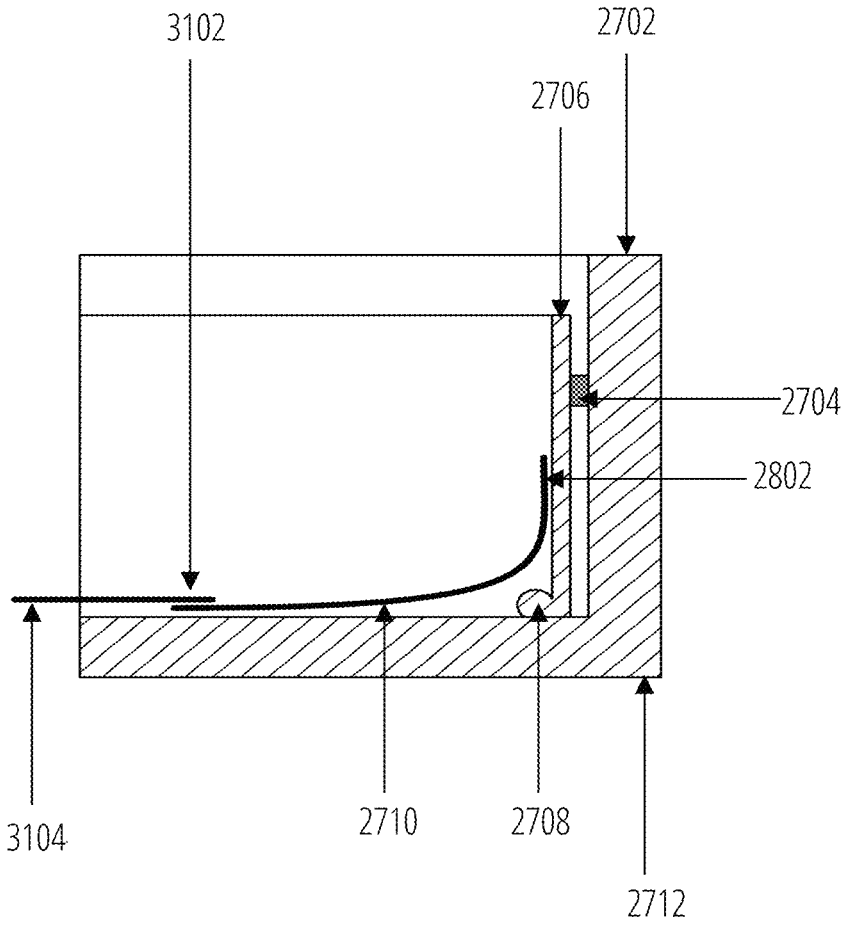
FIG. 31 illustrates a top view of an additional embodiment of apparatus of the invention.

FIG. 31 is a side cross sectional view of an additional embodiment of apparatus of the invention also showing the relative positioning of the apparatus in relation to footing 2712 and foundation wall 2702 when installed. In the embodiment as shown, the plastic sheeting or membrane 2710 is attached to the front face of the vertical member 2706 below the level of the gasket 2704. Again, the length of plastic sheeting or membrane 2710 is permanently fixed and sealed to the vertical member 2706 or flange section along the entire length of the apparatus. The width of plastic sheeting or membrane 2710 which is attached on one side to the vertical member 2706 or flange is arbitrary. The width of the plastic sheeting or membrane 2710 must be sufficiently wide so as to extend beyond the footing membrane 3104. The overlap between the plastic sheeting or membrane 2710 is to be secured and sealed t the joining section 3102, by a method such as an adhesive tape, caulking, solvent, to the footing membrane 3104 which a worker has already laid upon the granular fill. By doing so, this creates a permanent seal under the concrete slab, all the way to the side of the vertical member 2706 sealed by the means of attachment 2802.

Figure 32:
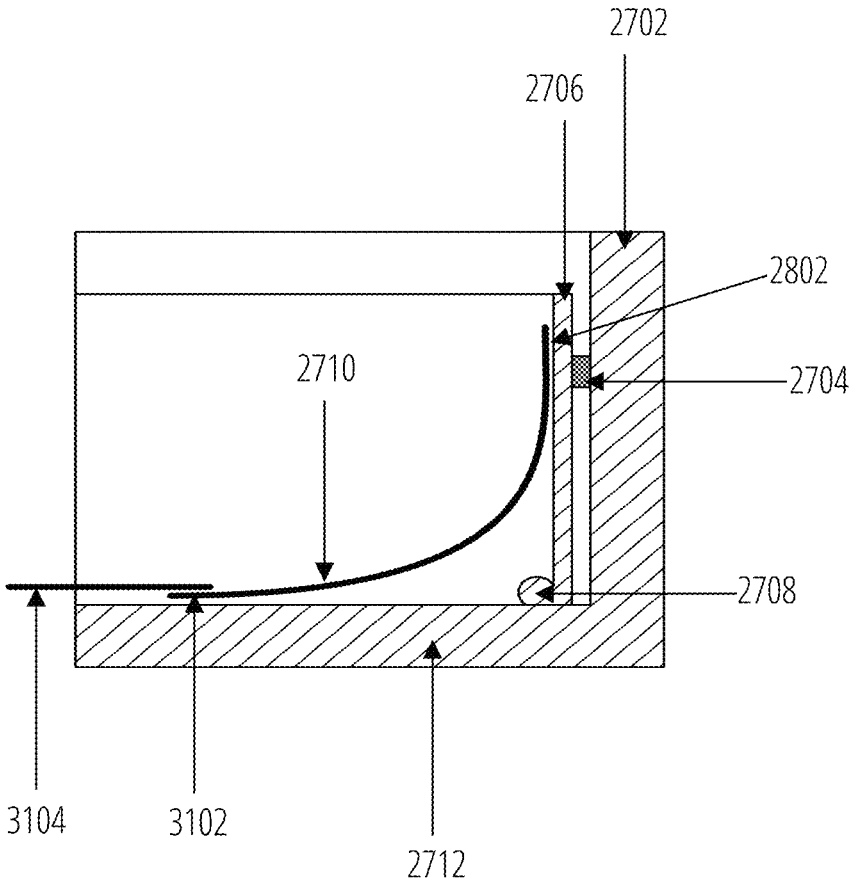
FIG. 32 illustrates a top view of an additional embodiment of apparatus of the invention.

FIG. 32 is a side cross sectional view of an additional embodiment of apparatus of the invention also showing the relative positioning of the apparatus in relation to footing 2712 and foundation wall 2702 when installed. In the embodiment as shown, the plastic sheeting or membrane 2710 is attached to the front face of the vertical member 2706 above the level of the gasket 2704. Again, the length of plastic sheeting or membrane 2710 is permanently fixed and sealed to the vertical member 2706 or flange section along the entire length of the apparatus. Again, the overlap between the plastic sheeting or membrane 2710 is to be secured and sealed to the footing membrane 3104 to create a permanent seal at the joining section 3102 under the concrete slab, all the way to the side of the vertical member 2706 sealed by the means of attachment 2802.

Figure 33:
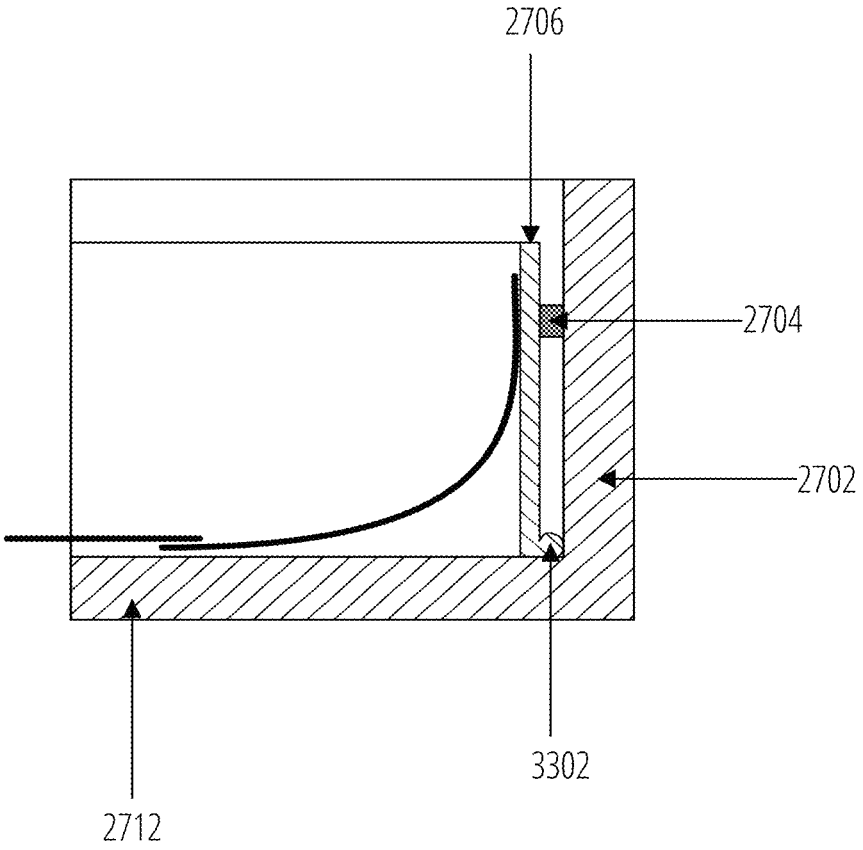
FIG. 33 illustrates a top view of an additional embodiment of apparatus of the invention.

FIG. 33 is a side cross sectional view of an additional embodiment of apparatus of the invention also showing the relative positioning of the apparatus in relation to footing 2712 and foundation wall 2702 when installed. In the embodiment as shown, the vertical member 2706 has a reversed foot 3302 above the level of the gasket 2704. The reversed foot 3302 must be sized and proportioned such that it does not extend beyond the width of the gasket 2704.

Figure 34:
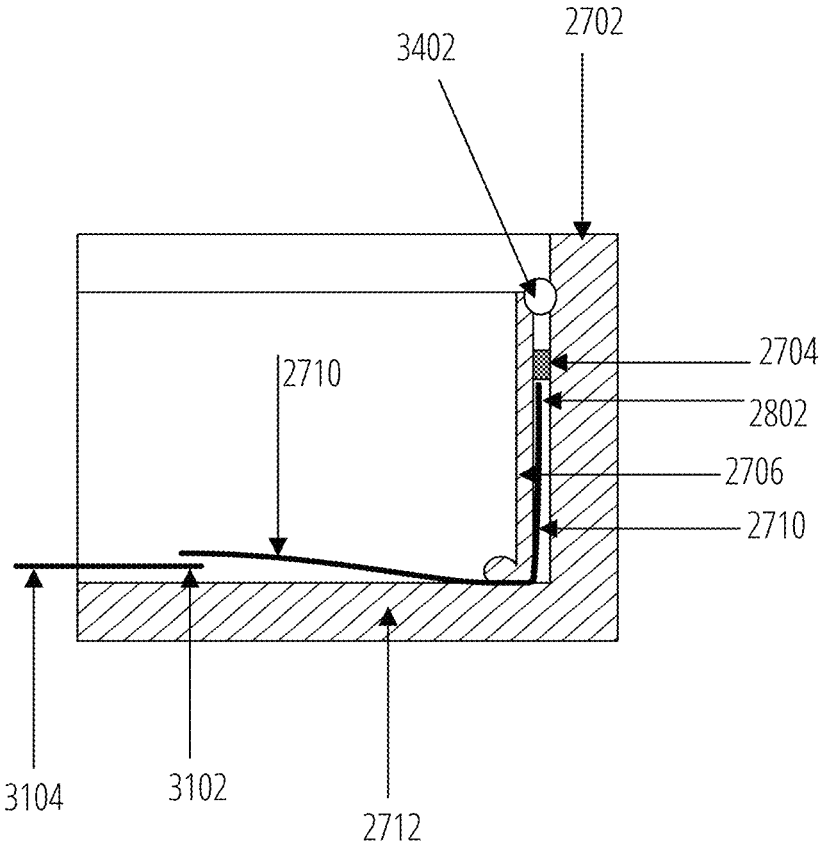
FIG. 34 illustrates an aspect of the subject matter in accordance with one embodiment.

FIG. 34 is a side cross sectional view of yet an additional embodiment of apparatus of the invention also showing the relative positioning of the apparatus in relation to footing 2712 and foundation wall 2702 when installed. In the embodiment as shown, the plastic sheeting or membrane 2710 is attached to the back or rear face of the vertical member 2706 below the level of the gasket 2704. Again, the length of plastic sheeting or membrane 2710 is permanently fixed and sealed to the vertical member 2706 or flange section along the entire length of the apparatus with a layer of sealant 3402. The width of plastic sheeting or membrane 2710 which is attached on one side to the vertical member 2706 or flange is arbitrary. The width of the plastic sheeting or membrane 2710 however must be sufficiently wide so as to extend beyond the footing membrane 3104. The overlap between the plastic sheeting or membrane 2710 is to be secured and sealed at the joining section 3102, to the footing membrane 3104 which a worker has already laid upon the granular fill. By doing so, this creates a permanent seal under the concrete slab, all the way to the side of the vertical member 2706 sealed by the means of attachment 2802.

A worker skilled in the art will understand that the embodiments of the invention as disclosed can be secured to the foundation of the building by means known to such worker. For example; the gasket 2704 or seal on the back or wall side of the vertical member 2706 or flange can include a pliable gasket already attached to the backside of the vertical member 2706 or flange, or a bead of acoustic sealant, silicone, expanding foam, rubberized foam etc. This gasket 2704 or seal will need to be applied between the foundation wall and vertical member 2706 or flange to prevent ground gasses from seeping through this void and into the structure.

In alternative embodiments of the invention the elements comprise a multi-piece unitary design. In this embodiment, the plastic sheeting or membrane 2710 is permanently attached to the vertical member 2706 or flange.

Various designs as described herein comprise a foot 2708 and a vertical member 2706 or flange to be attached to the foundation wall. The foot 2708 may be either front or rear facing. The gasket 2704 or seal on the back or wall side prevents ground gasses from entering the structure around the side of the vertical member 2706 or flange. The plastic sheeting or membrane 2710 may be attached to the vertical member 2706 or flange by way of a mechanical clip or fastener at the job site. Or, in alternative embodiment the plastic sheeting or membrane 2710 may be permanently attached to the vertical member 2706 or flange.

The plastic sheeting or membrane 2710 may be attached to the front face of the vertical member 2706 or flange either permanently or via a mechanical clip or fastener, or it may be attached to the rear or wall face of the vertical member 2706 or flange, again either permanently or via a mechanical clip or fastener.

While it is disclosed the above apparatus and related methods are directed toward the mitigation of radon vapor, the above apparatus and related methods may also be applied to the vapor mitigation of other gasses. Further, the above apparatus and related methods may also be applied for the fastening of tarps, membranes, poly layers and other protective layers.

While preferred embodiments of the present inventive concept have been shown and disclosed herein, it will be obvious to those persons skilled in the art that such embodiments are presented by way of example only, and not as a limitation to the scope of the inventive concept. Variations, changes, and substitutions may occur or be suggested to those skilled in the art without departing from the intent, scope, and totality of this inventive concept. Such variations, changes, and substitutions may involve other features which are already known per se and which may be used instead of, in combination with, or in addition to features already disclosed herein. Accordingly, it is intended that this inventive concept be inclusive of such variations, changes, and substitutions, and by no means limited by the scope of the claims presented herein.

The invention claimed is:

1. A vapor mitigation apparatus for use in sealing a footing membrane or radon gas membrane positioned between a granular fill and a building slab during construction of a building, the building having a foundation wall having an inner and an outer surface, and a footing, the apparatus comprising:

a vertical member configured to be affixed to the foundation wall, the vertical member having a first end located proximate to the footing and a second end, and an inner surface facing away from the foundation wall, and an outer surface facing the foundation wall;

a horizontal foot located at the first end of the vertical member wherein the horizontal foot is configured to rest upon the footing and extends towards the foundation wall;

a means of sealing and securing the vertical member to the foundation wall selected from a pliable gasket, bead of acoustic sealant, silicone, expanding foam, rubberized foam, adhesion strip, or securing fasteners; and a plastic sheet or membrane permanently fixed and sealed to the vertical member configured to extend part way across the footing beyond the footing membrane covering the granular fill for sealing therewith, thereby creating a seal under the building slab.

2. The vapor mitigation apparatus of claim 1, wherein the vertical member is attached to the inner surface of the building.

3. The vapor mitigation apparatus of claim 1, wherein the vertical member is attached to the outer surface of the building.

4. The vapor mitigation apparatus of claim 1, wherein the plastic sheet or membrane is permanently fixed and sealed to the outer surface of the vertical member.

5. The vapor mitigation apparatus of claim 1, wherein the plastic sheet or membrane is permanently fixed and sealed to the inner surface of the vertical member.

6. The vapor mitigation apparatus of claim 1, wherein the plastic sheet or membrane is permanently fixed and sealed to the vertical member by gluing, welding, or solvent welding.

7. The vapor mitigation apparatus of claim 3, wherein the gluing uses hot melt glue.

* * * * *